US011089836B2

(12) United States Patent
Truelsen et al.

(10) Patent No.: US 11,089,836 B2
(45) Date of Patent: Aug. 17, 2021

(54) CUP-SHAPED SHANK FOR HEELED SHOES

(71) Applicant: ECCO Sko A/S, Bredebro (DK)

(72) Inventors: Ejnar Truelsen, Tønder (DK); Frank Jensen, Bredebro (DK); Hans Christian Hansen, Løgumkloster (DK); Niki Tæstensen, Flensborg (DK)

(73) Assignee: ECCO Sko A/S, Bredebro (DK)

( * ) Notice: Subject to any disclaimer, the term of this patent is extended or adjusted under 35 U.S.C. 154(b) by 221 days.

(21) Appl. No.: 16/257,903

(22) Filed: Jan. 25, 2019

(65) Prior Publication Data

US 2019/0289964 A1 Sep. 26, 2019

Related U.S. Application Data

(63) Continuation of application No. 15/068,781, filed on Mar. 14, 2016, now Pat. No. 10,231,515.

(30) Foreign Application Priority Data

Mar. 16, 2015 (EP) ..... 15159200

(51) Int. Cl.
*A43B 23/22* (2006.01)
*A43B 13/37* (2006.01)
(Continued)

(52) U.S. Cl.
CPC ..... *A43B 23/222* (2013.01); *A43B 13/141* (2013.01); *A43B 13/37* (2013.01); *A43B 21/38* (2013.01); *A43B 21/46* (2013.01)

(58) Field of Classification Search
CPC ..... A43B 23/22; A43B 23/222; A43B 23/225; A43B 23/227; A43B 13/37; A43B 13/41; A43B 13/141; A43B 21/38; A43B 21/46
See application file for complete search history.

(56) References Cited

U.S. PATENT DOCUMENTS 1,597,886 A 8/1926 Hawthorne
1,847,287 A 3/1932 White
(Continued)

FOREIGN PATENT DOCUMENTS

CN 101837624 5/2011
CN 102920101 2/2013
(Continued)

OTHER PUBLICATIONS

European Search Report for corresponding application EP 15159200; Report dated Aug. 27, 2015.

*Primary Examiner* — Ted Kavanaugh
(74) *Attorney, Agent, or Firm* — Finnegan, Henderson, Farabow, Garrett and Dunner LLP

(57) ABSTRACT

The present invention relates to a shank adapted for being integrated into a shoe sole and for mounting a heel element, wherein said shank at its heel portion is adapted to be connected to the heel element and wherein said shank comprises an upper surface pointing towards the inner shoe. At least a part of the upper surface at the heel portion is cup-shaped and adapted for receiving sole material inside the cup when integrating said shank in said sole during moulding of said shoe sole. Thereby, due to the amount of sole material present in the heel portion, the sole material covers the means used for connecting the shank to the heel element. Thereby, based on the properties of the sole material, the heeled shoe becomes comfortable and flexible at the heel portion. The invention further relates to a sole for a shoe with a cup-shaped shank and more specifically to a shoe with a cup-shaped shank.

21 Claims, 3 Drawing Sheets

(51) Int. Cl.

| | |
|---|---|
| ***A43B 13/14*** | (2006.01) |
| ***A43B 21/38*** | (2006.01) |
| ***A43B 21/46*** | (2006.01) |

(56) References Cited

U.S. PATENT DOCUMENTS

| | | | | |
|---|---|---|---|---|
| 1,895,660 | A | 1/1933 | Hauck | |
| 2,099,394 | A | 11/1937 | Hiram | |
| 2,171,719 | A | 9/1939 | Whelton | |
| 2,263,187 | A | 11/1941 | Parkhurst | |
| 4,439,937 | A | 4/1984 | Daswick | |
| 5,416,989 | A | 5/1995 | Preston | |
| 5,720,117 | A | 2/1998 | Toschi | |
| 5,722,186 | A | 3/1998 | Brown | |
| 7,421,808 | B2 | 9/2008 | Baier et al. | |
| 10,231,515 | B2 * | 3/2019 | Truelsen | A43B 21/38 |
| 2006/0277795 | A1 | 12/2006 | Baier | |
| 2011/0030245 | A1 | 2/2011 | Truelsen | |
| 2015/0052777 | A1 | 2/2015 | Jennings | |

FOREIGN PATENT DOCUMENTS

| | | | |
|---|---|---|---|
| DE | 2949149 | A1 | 6/1980 |
| FR | 1211345 | | 3/1960 |
| FR | 2678810 | | 1/1993 |
| GB | 347279 | | 4/1931 |
| GB | 1003951 | A | 9/1965 |
| GB | 2053073 | A | 2/1981 |
| WO | WO 2005096860 | A1 | 10/2005 |
| WO | WO 2013041105 | A | 3/2013 |

* cited by examiner

CUP-SHAPED SHANK FOR HEELED SHOES

CROSS REFERENCE TO RELATED APPLICATIONS

This is a continuation of U.S. patent application Ser. No. 15/068,781, filed Mar. 14, 2016, which claims priority to European Patent Application No. 15159200.3, filed Mar. 16, 2015, all of which are incorporated by reference herein in their entireties and from each of which the benefits of priority are claimed.

FIELD OF THE INVENTION

The present invention relates to a cup-shaped shank for a heeled shoe. The invention further relates to a sole for a heeled shoe with a cup-shaped shank and more specifically to a heeled shoe with a cup-shaped shank.

BACKGROUND

An important aspect when wearing shoes is that the shoe should be comfortable to wear. Elements that can increase the comfort of wearing a shoe includes flexibility of the shoe sole and another aspect may be the softness of the surface inside the shoe having contact with the surface of the foot wearing the shoe.

Normally, the comfort of a shoe is optimised by having specific properties of the sole material, but sometimes a specific sole material needs to be used due to design requirements or the type of shoe or due to the type of shoe determining specific design elements.

GENERAL DESCRIPTION

In accordance with the invention, a shank is provided adapted for being integrated into a shoe sole and for mounting a heel element, wherein said shank at its heel portion is adapted to be connected to the heel element and wherein said shank comprises an upper surface pointing towards the inner shoe. At least a part of the upper surface at the heel portion is cup-shaped and adapted for receiving sole material inside the cup when integrating said shank in said sole during moulding of said shoe sole.

Thereby, due to the amount of sole material present in the heel portion, the means used for connecting the shank to the heel element are covered by the sole material. Thereby, based on the properties of the sole material, the heeled shoe becomes comfortable and flexible at the heel portion. Further, the cup shape ensures that the flexibility increases towards a centre axis of the cup shape since more sole material is present at the centre, typically above the aperture and the fastening means. Typically, and especially regarding high-heeled footwear, the contact point between foot and shoe at the heel can be uncomfortable. By having a cup shape at the heel, a much more flexible surface can be obtained, whereby the high-heeled shoe is more comfortable to wear.

The connection between shank and heel element maybe via, e.g., screws or nails inserted through the shank towards the heel element. Other fastening means such as glue may also be used.

In an embodiment, the shank comprises a heel portion and a front portion and wherein the shank is shaped to extend from the heel via the heel portion towards the front of a shoe and wherein the cup shape at the heel portion decreases towards the front portion. Thereby, after moulding, more sole material is present at the upper part at the heel portion than at the front portion, which ensures that flexibility gradually decreases along the middle portion towards the front portion.

In an embodiment, the entire upper surface of the shank is cup-shaped. Thereby, the entire inner surface is more comfortable.

In an embodiment, the shank at its heel portion comprises an aperture for inserting fastening means for obtaining a connection to the heel element. Thereby, due to the amount of sole material present in the heel portion, sole material covers the aperture as well as the top of the fastening means.

The fastening means may be, e.g., a screw or bolt and they can be inserted for connecting a heel element to the cup-shaped shank.

In an embodiment, the aperture is shaped for receiving said fastening means, whereby the fastening means are below the upper surface of the shank when mounted. Thereby, it is ensured that the fastening means do not reduce the comfort of the shoe.

In an embodiment, the shank is shaped for following the contour of a foot wearing a heeled shoe and wherein when the front portion of the shank rests on a surface, the shank part behind the front portion are inclined upwards and away from said surface ending at the heel portion of the shank. Thereby, space is obtained below the heel portion, whereby a heel element can be mounted and a shoe can be made following the shape of the foot when wearing the heeled shoe.

In an embodiment the shank has multiple holes through which sole material can flow when moulding said shoe sole. Thereby, the moulding process becomes faster.

In an embodiment, said multiple holes comprise a row of holes extending from the heel portion towards the front portion positioned along a central axis of the shank. In an alternative, multiple holes are positioned along the edge of the shank at the heel portion extending towards the front portion.

By specific positioning of the holes according to the above, it can be ensured that the flow of sole material can be controlled in an optimal manner.

The invention further relates to a sole for a shoe with a cup-shaped shank and more specifically to a shoe with a cup-shaped shank.

BRIEF DESCRIPTION OF DRAWINGS

The invention is explained in detail below with reference to the drawings, in which.

DETAILED DESCRIPTION OF DRAWINGS

Figure 1A:
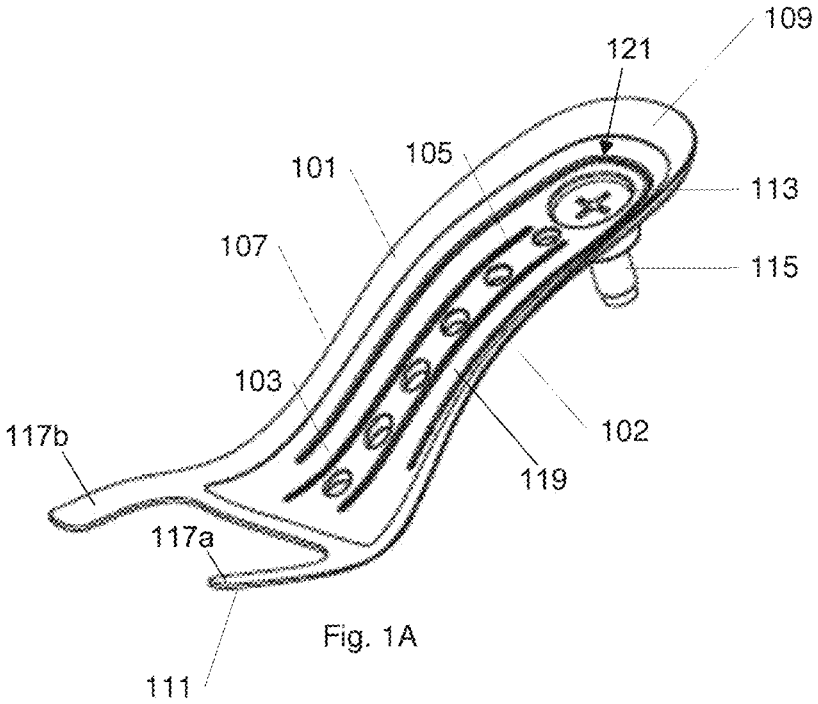
FIG. 1A illustrates an embodiment of a cup-shaped shank according to the present invention.
Figure 1B:
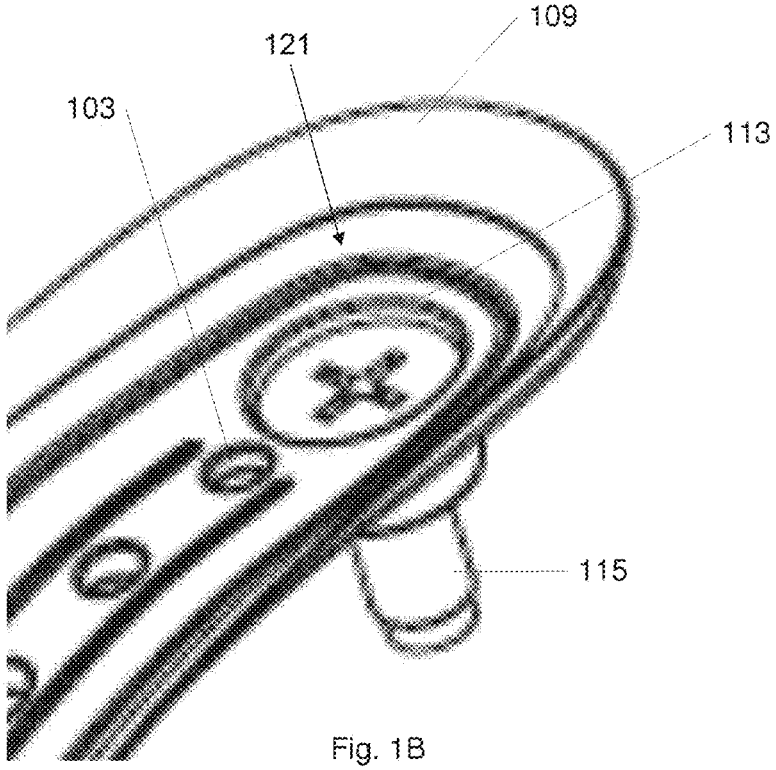
FIG. 1B illustrates an enlarged partial view of the shank of FIG. 1A.

FIG. 1A illustrates an embodiment of a cup-shaped shank according to the present invention and FIG. 1B is a zoom on the heel portion of the shank illustrated in FIG. 1A. The cup-shaped shank is for integrating in a sole when moulding the shoe and by adding the cup-shaped shank to the sole, specific shapes as well as stiffness can be added to the sole material. Producing a shoe with a cup-shaped shank according to the present invention, may be done by positioning the cup-shaped shank in a mould, and then injecting the sole material into the mould to shape the sole. Material is injected to be present on both sides of the cup-shaped shank and thereby the cup-shaped shank is completely integrated in the sole material after hardening.

As can be seen from FIGS. 1A and 1B, the cup-shaped shank according to the present invention comprises an upper surface 101 and an opposite lower surface 102. At the upper surface 101, the shank has a cup shape, which is mainly at the heel portion 109 and which defines a volume 121 configured to receive the sole material, whereby more flexible sole material can be present at central part 105 of the upper surface of the cup-shaped shank compared to the edge 107 of the cup-shaped shank. Less flexible material may be present at the edge 107 to maintain stiff edges, whereby the inner sole surface of the shoe for contacting the foot has a softness, which gradually increases from the edge towards the center.

In FIGS. 1A and 1B, the upper surface 101 of the shank is cup-shaped at the heel portion and the cup gradually decreases from the heel portion 109 towards the front portion 111 of the shank. Thereby, a larger amount of flexible sole material can be present at the heel portion 109, which again results in more softness and a more flexible contact point between the heel portion of the shoe and the heel of a foot. The cup shape receives sole material inside the cup when integrating said shank in said sole during moulding of said shoe sole. As a result, the shank may have a larger cross-sectional area in heel portion 109 than in front portion 111 and in an arch portion 119 of the shank. Additionally, or alternatively, the shank may have a smaller cross-sectional area in the front portion 111 than in the heel portion 109 and the arch portion 119.

In another embodiment of a cup-shaped shank according to the present invention, it may be only the heel portion of the shank that is cup-shaped. In yet another embodiment, the shank of the present invention is only a cup-shaped heel shank and solely for obtaining specific properties of the heel portion of a sole. In such an embodiment, the cup-shaped shank may be the only shank in the sole, but alternatively another shank supplementing the cup-shaped shank may be used for the sole.

From FIGS. 1A and 1B, it can be seen that the cup-shaped shank comprises a number of holes 103, whereby injected sole material can float/flow through the cup-shaped shank, e.g., from the lower surface 102 to the upper surface 101. Thereby, it becomes easier to ensure that injected material is present on both lower surface 102 and the upper surface 101 of the cup-shaped shank and that the cup-shaped shank is completely integrated into the sole.

The multiple holes 103 may extend from the heel portion towards the front portion positioned along a central axis of the shank and there may further be holes 103 positioned along the edge of the shank at the heel portion 109, which extends towards the front portion 111.

In FIGS. 1A and 1B, aside from the cup-shaped upper surface 101, the cup-shaped shank is also shaped with a curved side profile according to the sole design of a heeled shoe. Thereby, when the front portion 111 of the sole rests on a surface, a heel element (not shown) can be positioned to support the heel portion 109 of the sole. As depicted in FIG. 1A, front portion 111 may include a first structural element 117*a* and second structural element 117*b*. In one embodiment, the cup-shaped shank used for such a sole may be shaped similarly, whereby when the front portion of the shank rests on a surface, the shank part behind the front portion is inclined upwards and away from the surface ending at the heel portion of the shank. The curvature of the side profile depends on the design of the shoe and more specifically on the height of the heel elements.

In FIGS. 1A and 1B, the shank 101 at its heel portion 109 comprises an aperture 113 for inserting fastening means 115 for obtaining a connection between a heel element (not shown). Further, it can be seen how the top level of the fastening means 115 is lowered in the aperture at a level lower than the upper surface of the shank. Fastening means 115 may be, e.g., a bolt or a screw for interacting with the corresponding hole in the heel element (not shown).

The aperture may be shaped in such a manner that when inserting the fastening means, such as a screw or bolt, the top surface of the head of the screw or bolt is below the upper surface of the cup-shaped shank. Further, the aperture may be shaped according to the shape of the head of the screw or bolt to further ensure a good contact between the fastening means and the cup-shaped shank. In an embodiment, the edge of the hole may be corrugated to interact with the screw or bolt and lock the screw or bolt to the heel element when fastened, minimising the risk of the heel element becoming loose during use of the shoe.

In one embodiment, a heel element is connected to the cup-shaped shank before injecting sole material, and sole material is injected to cover both the heel element as well as the cup-shaped shank. Alternatively, the sole material is injected around the cup-shaped shank and afterwards a heel element is mounted via fastening means. This may in one embodiment be via a screw or bolt through an aperture in the cup-shaped shank or it may be by using other fastening means such as nails or glue.

Figure 2A:
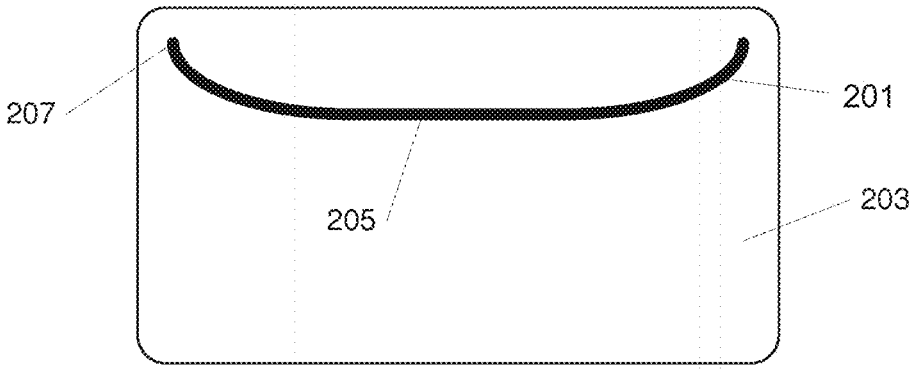
FIG. 2A illustrates a transverse cut through a heel of a sole comprising a cup-shaped shank.

FIG. 2A illustrates a transverse cut through the heel of a sole comprising a cup-shaped shank, the cup-shaped shank 201 being integrated in the sole material 203. It can be seen how more sole material is present at the center 205 than at the edge 207. The curve of the cup shape can be chosen to obtain optimal properties of the sole with the integrated cup-shaped shank.

Figure 2B:
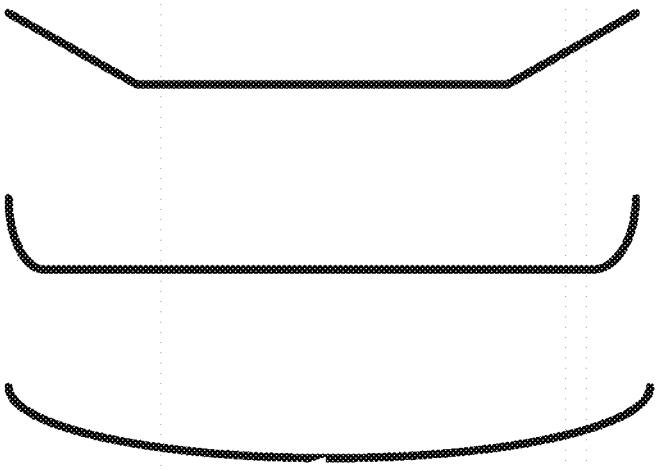
FIG. 2B illustrates alternative curvatures of the cup shape.

FIG. 2B illustrates different curvatures of the cup shape, which can be chosen depending on the properties to be obtained in the shoe.

Figure 3:
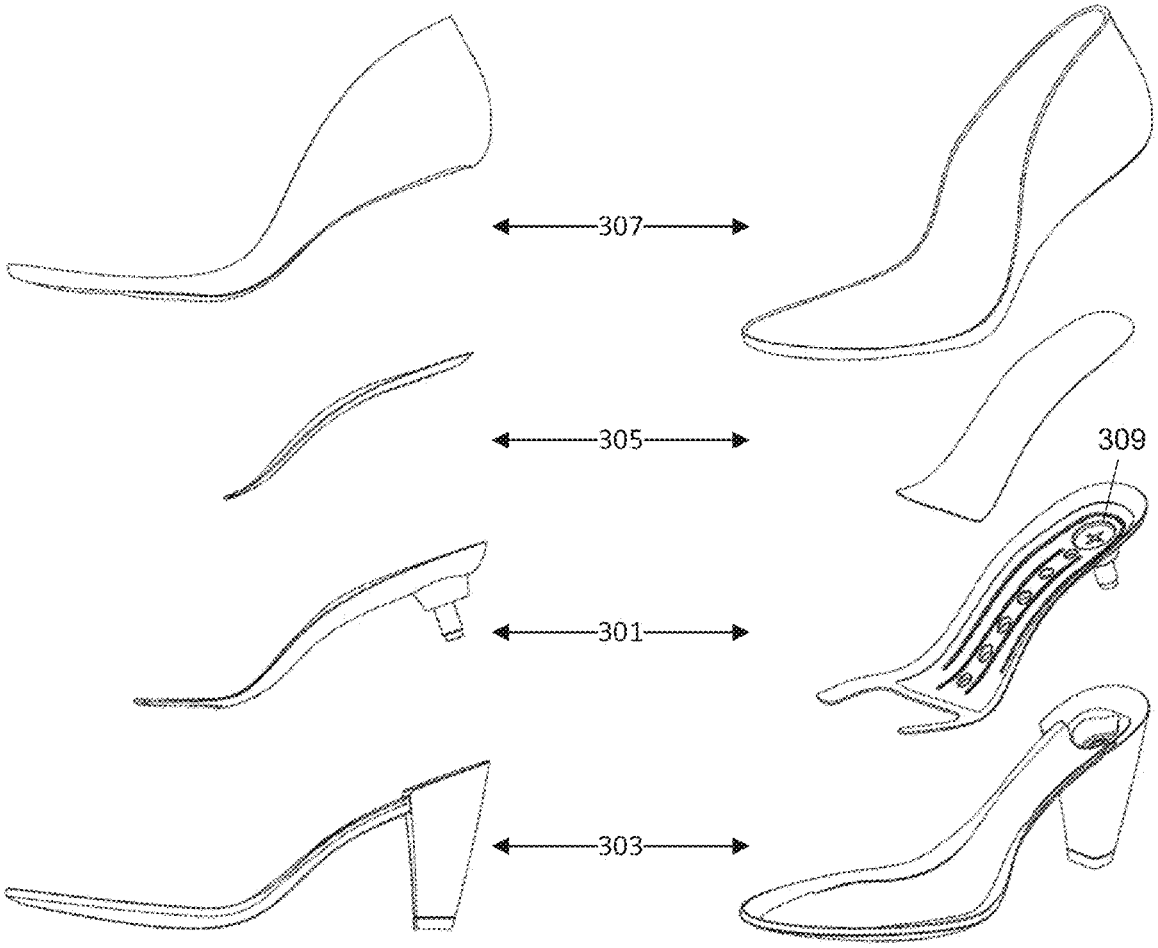
FIG. 3 illustrates an exploded view of a shoe with a heel from both the side and front.

FIG. 3 illustrates the element of a shoe with a heel from both the side and front. The embodiment of the shank 301 according to the present invention is connected to the heel element 303 via the fastening means through the aperture 309 in the shank 301. Further, the shoe comprises a sole 305 and an upper 307.

The invention claimed is:

1. An injection molded shoe sole, comprising:

a heel element;

a shank for mounting the heel element in the injection molded shoe sole, the shank including:

a front portion configured to be parallel to a ground-contacting surface of the shoe sole, an arch portion, and a heel portion configured to be connected to the heel element, wherein the shank includes a plurality of through-going holes, wherein the arch portion and the heel portion are arranged at an angle to the front portion such that the arch portion and the heel portion extend in a direction away from a ground-facing surface of the front portion, and wherein at least a part of a foot-facing surface of the heel portion is cup-shaped, the cup-shaped portion defining a volume configured to receive a sole material of the injection molded shoe sole;

a first layer of the sole material positioned within the volume defined by the cup-shaped portion; and a second layer of the sole material positioned on a ground-facing surface of the shank, wherein the first layer and the second layer of the sole material are connected via a connecting portion of the sole material extending through the plurality of holes of the shank.

2. The injection molded shoe sole of claim 1, wherein the cup-shaped portion decreases in volume from the heel portion to the front portion.

3. The injection molded shoe sole of claim 1, wherein the heel portion comprises an aperture configured to receive a fastening means, the fastening means being configured to connect the heel portion of the shank to the heel element.

4. The injection molded shoe sole of claim 3, wherein the aperture defines a volume for inserting the fastening means through the aperture such that a foot-facing surface of the fastening means is disposed between the foot-facing surface of the heel portion and a ground-facing surface of the heel portion.

5. The injection molded shoe sole of claim 1, wherein the connecting portion of the sole material flows through the plurality of holes of the shank during an injection molding of the shoe sole.

6. The injection molded shoe sole of claim 5, wherein the plurality of holes of the shank are disposed in a row along a central axis extending from the heel portion to the front portion.

7. The injection molded shoe sole of claim 5, wherein the plurality of holes of the shank are disposed along a first edge of the shank and a second edge of the shank, the first and second edges of the shank extending from the heel portion to the front portion.

8. The injection molded shoe sole of claim 1, further comprising a plurality of structural elements configured to increase the rigidity of a forefoot portion of the injection molded shoe sole.

9. The injection molded shoe sole of claim 1, further comprising a first structural element disposed in a medial part of the front portion and a second structural element disposed in a lateral part of the front portion.

10. The injection molded shoe sole of claim 9, wherein the first structural element and the second structural element are separated from each other in a transverse direction, and configured such that the sole material can be injected in the area defined by the first structural element and the second structural element.

11. The injection molded shoe sole of claim 1, wherein the shank includes a lateral edge and a medial edge, wherein the lateral edge and medial edge are disposed above a central portion of the shank and wherein the lateral edge and the medial edge define a volume configured to receive the sole material.

12. The injection molded shoe sole of claim 1, wherein the shank includes a lateral edge and a medial edge positioned above a central portion of the shank and defining a first cross-sectional area taken along a transverse plane between the medial edge and the lateral edge, the first cross-sectional area being curved such that the shank is configured to receive the sole material during injection molding of the shoe sole.

13. The injection molded shoe sole of claim 12, wherein the medial edge and the lateral edge of the shank define a second cross-sectional area taken along a transverse plane between the medial edge and the lateral edge in the arch portion of the shank, the second cross-sectional area being curved such that the arch portion is configured to receive the sole material during the injection molding of the shoe sole.

14. The injection molded shoe sole of claim 13, further comprising a foot-facing surface of the shank, wherein the sole material is disposed on the foot-facing surface of the shank, and wherein a highest point of the sole in the second cross-sectional area is at least one of the medial edge or the lateral edge of the shank.

15. The injection molded shoe sole of claim 13, wherein the medial edge and the lateral edge of the shank define a third cross-sectional area taken along a transverse plane between the medial edge and the lateral edge in the front portion of the shank, the third cross-sectional area being curved such that the front portion is configured to receive the sole material during the injection molding of the shoe sole.

16. The injection molded shoe sole of claim 15, wherein the first cross-sectional area is larger than the third cross-sectional area.

17. The injection molded shoe sole of claim 13, wherein the first cross-sectional area is larger than the second cross-sectional area.

18. The injection molded shoe sole of claim 13, wherein the second cross-sectional area is larger than the third cross-sectional area.

19. The injection molded shoe sole of claim 1, further comprising a ground-facing surface of the heel portion, wherein the heel element is attached to the ground-facing surface of the heel portion of the shank.

20. The injection molded shoe sole of claim 1, further comprising a ground-facing surface of the arch portion, wherein the sole material covers the ground-facing surface of the front portion and the ground-facing surface of the arch portion.

21. The injection molded shoe sole of claim 20, further comprising a foot-facing surface of the shank, wherein the sole material is disposed on the foot-facing surface of the shank extending from a central area of the shank towards a lateral edge and a medial edge of the heel portion, wherein a larger amount of the sole material on the foot-facing surface of the shank is disposed at the central area of the shank than at least one of the lateral edge or the medial edge of the heel portion.

* * * * *